US009932655B2

(12) United States Patent
Hamaguchi et al.

(10) Patent No.: US 9,932,655 B2
(45) Date of Patent: Apr. 3, 2018

(54) NI-BASED ALLOY

(71) Applicant: Nippon Steel & Sumitomo Metal Corporation, Tokyo (JP)

(72) Inventors: Tomoaki Hamaguchi, Tokyo (JP); Hiroyuki Semba, Tokyo (JP); Hirokazu Okada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 496 days.

(21) Appl. No.: 14/402,418

(22) PCT Filed: Jun. 5, 2013

(86) PCT No.: PCT/JP2013/065588
§ 371 (c)(1),
(2) Date: Nov. 20, 2014

(87) PCT Pub. No.: WO2013/183670
PCT Pub. Date: Dec. 12, 2013

(65) Prior Publication Data

US 2015/0159241 A1 Jun. 11, 2015

(30) Foreign Application Priority Data

Jun. 7, 2012 (JP) ..... 2012-129649

(51) Int. Cl.
*C22C 19/05* (2006.01)
*C22C 30/00* (2006.01)

(52) U.S. Cl.
CPC ..... *C22C 19/056* (2013.01); *C22C 19/055* (2013.01); *C22C 30/00* (2013.01)

(58) Field of Classification Search
CPC ..... C22C 19/055; C22C 19/056; C22F 1/10
See application file for complete search history.

(56) References Cited

U.S. PATENT DOCUMENTS

| | | | | |
|---|---|---|---|---|
| 2002/0185197 | A1* | 12/2002 | Farr | C22C 19/055 148/428 |
| 2011/0064569 | A1* | 3/2011 | Yamada | C22C 19/055 415/200 |
| 2012/0288400 | A1 | 11/2012 | Hirata et al. | |

FOREIGN PATENT DOCUMENTS

| | | |
|---|---|---|
| EP | 0633325 | 1/1995 |
| EP | 1095167 | 5/2001 |
| EP | 2298946 | 3/2011 |
| EP | 2330225 | 6/2011 |
| JP | 51-084726 | 7/1976 |
| JP | 51-084727 | 7/1976 |
| JP | 61-079742 | 4/1986 |
| JP | 07-150277 | 6/1995 |
| JP | 07-216511 | 8/1995 |
| JP | 08-127848 | 5/1996 |
| JP | 08-218140 | 8/1996 |
| JP | 09-157779 | 6/1997 |
| JP | 2002-518599 | 6/2002 |
| JP | 4697357 | 6/2011 |
| JP | 2013036086 | 2/2013 |
| KR | 1020110054070 | 5/2011 |
| WO | 9967436 | 12/1999 |
| WO | WO 99/67436 A1 | 12/1999 |
| WO | WO 2010/038826 | 4/2010 |
| WO | WO 2013/021853 | 2/2013 |

OTHER PUBLICATIONS

Notice of Allowance dated May 26, 2016 issued in corresponding Korean Application No. 10-2014-7033863 [with English Translation].
International Search Report dated Sep. 3, 2013 issued in corresponding PCT Application No. PCT/JP2013/065588 [with English Translation].
Search Report dated Jan. 26, 2016 issued in corresponding European Application No. 13800201.9.

* cited by examiner

*Primary Examiner* — Jessee Roe
(74) *Attorney, Agent, or Firm* — Birch, Stewart, Kolasch & Birch, LLP

(57) ABSTRACT

A Ni-based alloy includes, as a chemical composition, C, Si, Mn, Cr, Mo, Co, Al, Ti, B, P, S, and a balance consisting of Ni and impurities. The average grain size d is 10 μm to 300 μm, when the average grain size d is an average grain size in unit of μm of a γ phase included in a metallographic structure of the Ni-based alloy. Precipitates with a major axis of 100 nm or more are absent in the metallographic structure. An area fraction ρ is f2 or more, when the area fraction ρ and the f2 are expressed by using the average grain size d and amounts in mass % of each element in the chemical composition.

16 Claims, No Drawings

NI-BASED ALLOY

This application is a national stage application of International Application No. PCT/JP2013/065588, filed Jun. 5, 2013, which claims priority to Japanese Patent Application No. 2012-129649, filed on Jun. 7, 2012, each of which is incorporated by reference in its entirety.

TECHNICAL FIELD

The present invention relates to a Ni-based alloy. Specifically, the present invention relates to a high strength Ni-based alloy which is high in creep rupture strength (creep rupture time), creep rupture ductility, and reheat cracking resistance.

BACKGROUND ART

In recent years, ultra super critical boilers in which steam temperature and pressure are to increase for high efficiency have been newly built in the world. Specifically, it is planned to increase the steam temperature which is heretofore approximately 600° C. up to 650° C. or more, or further up to 700° C. or more, and to increase the steam pressure which is heretofore approximately 25 MPa up to approximately 35 MPa. The reason for the above is based on the fact that energy saving, efficient use of resources, and reduction in $CO_2$ emission for environmental protection are one of objects for solving energy problems and are important industrial policies. In addition, in a case of boilers for power generating plants and reacting furnaces for chemical industrial plants where fossil fuel is combusted, it is advantageous to use high efficient ultra super critical boilers and high efficient reacting furnaces.

With increasing the steam temperature and pressure, the temperature of plates, forgings, or the like which are used as superheater tubes in boilers, chemical industrial reaction tubes, and heat resisting and pressure resisting materials increases up to 700° C. or more during actual operation. Thus, it is required for the alloy used in the above severe environment for a long time to be excellent in not only high temperature strength and high temperature corrosion resistance but also creep rupture ductility or the like.

Furthermore, at the time of maintenance such as repairs after usage for a long time, it is necessary for materials aged by the usage for the long time to be subject to the treatment such as cutting, working, or welding. Thus, it has been eagerly required to have not only characteristics as new materials but also soundness as aged materials. In particular, it has been required to be excellent in reheat cracking resistance in order to make the welding possible after the usage for the long time.

With regard to the above severe requirements, in the conventional austenitic stainless steels or the like, creep rupture strength (creep rupture time) is insufficient. Thus, it is necessary to use a Ni-based heat resistant alloy in which precipitation strengthening derived from intermetallic compounds such as γ' phase is utilized. Herein, the creep rupture strength represents an estimated value obtained by Larson-Miller parameter using a creep test temperature and a creep rupture time. Specifically, the estimated value of creep rupture strength increases with an increase in the creep rupture time. Thus, in the present invention, the creep rupture time is used as a parameter of high temperature strength.

Patent Documents 1 to 9 disclose Ni-based alloys used in the severe environment such as high-temperature as described above. In the Ni-based alloys, solid solution strengthening is utilized by containing Mo and/or W, and precipitation strengthening derived from intermetallic compounds such as γ' phase, specifically $Ni_3(Al, Ti)$, is utilized by containing Al and Ti.

Among the Patent Documents, the alloys disclosed in the Patent Documents 4 to 6 include 28% or more of Cr, so that a large number of α-Cr phase having a bcc (body centered cubic) structure precipitates, which contributes to the strengthening.

RELATED ART DOCUMENTS

Patent Documents

[Patent Document 1] Japanese Unexamined Patent Application, First Publication No. S51-84726

[Patent Document 2] Japanese Unexamined Patent Application, First Publication No. S51-84727

[Patent Document 3] Japanese Unexamined Patent Application, First Publication No. H07-150277

[Patent Document 4] Japanese Unexamined Patent Application, First Publication No. H07-216511

[Patent Document 5] Japanese Unexamined Patent Application, First Publication No. H08-127848

[Patent Document 6] Japanese Unexamined Patent Application, First Publication No. H08-218140

[Patent Document 7] Japanese Unexamined Patent Application, First Publication No. H09-157779

[Patent Document 8] Published Japanese Translation No. 2002-518599 of the PCT International Publication

[Patent Document 9] International Publication No. WO 2010/038826

SUMMARY OF INVENTION

Technical Problem to be Solved

In the Ni-based alloys disclosed in the Patent Documents 1 to 8, since γ' phase or α-Cr phase precipitates, the high temperature strength is excellent, however the creep rupture ductility is inferior as compared with that of conventional austenitic heat resistant steels or the like. In particular, since the aging deterioration occurs after the usage for the long time, the ductility and toughness drastically decrease as compared with those of new materials.

At the time of periodical inspection after the usage for the long time and of maintenance for troubles during the usage, deteriorated materials need to be partly cut out and to be replaced with new materials. In this case, it is necessary to weld the new materials to the aged materials to be used. Moreover, it is necessary to partly bend the materials as required.

However, the Patent Documents 1 to 8 fail to disclose any solution in order to suppress the deterioration of the materials after the usage for the long time. Specifically, the Patent Documents 1 to 8 do not consider how to suppress the aging deterioration after the usage for the long time in the present large plant under unprecedented conditions such as higher temperature and higher pressure as compared with those of the past plant.

The Patent Document 9 considers the above problems and discloses the alloy which shows much higher strength than that of the conventional Ni-based heat resistant alloy, further improved ductility and toughness after the usage for the long time in the high-temperature, and improved hot workability.

However, the Patent Document 9 does not particularly consider the reheat cracking which may occur at welding.

The present invention has been made in consideration of the above mentioned situations. An object of the present invention is to provide the Ni-based alloy in which the creep rupture strength (creep rupture time) is improved by the solid solution strengthening and the precipitation strengthening of γ' phase, the ductility (creep rupture ductility) after the usage for the long time in the high-temperature is drastically improved, and the reheat cracking or the like which may occur at welding for repair or the like is suppressed.

Specifically, in the Ni-based alloy according to an aspect of the present invention, γ' phase or the like precipitates under usage environment in the plant, and as a result, the high temperature strength increases. In other words, in the Ni-based alloy according to the aspect of the present invention, since γ' phase or the like does not precipitate before being installed in the plant, which is the solid solution state, the plastic deformability is excellent. During the usage in the plant after being installed in the plant, the high temperature strength (creep rupture time) increases, and also the creep rupture ductility and the reheat cracking resistance are excellent. The object of the present invention is to provide the above mentioned Ni-based alloy.

Solution to Problem

The inventors have investigated how to improve the ductility after the usage for the long time in the high-temperature and to suppress the reheat cracking with respect to the Ni-based alloy which utilizes the precipitation strengthening of γ' phase (hereinafter, referred to as "γ' hardened Ni-based alloy"). Specifically, the inventors have investigated the creep rupture time, the creep rupture ductility, and the reheat cracking resistance with respect to the γ' hardened Ni-based alloy. As a result, the inventors have obtained the following findings (a) to (g).

(a) In order to improve the ductility after the usage for the long time in the high-temperature and to suppress the reheat cracking in the γ' hardened Ni-based alloy, it is necessary to control carbonitrides which precipitate during the usage in the plant. Specifically, it is effective to take account of an area fraction ρ which represents the area fraction of grain boundaries covered by the carbonitrides which precipitate in the grain boundaries with respect to the total grain boundaries.

(b) It is found that the area fraction ρ is quantified by an average grain size and amounts of B, C, and Cr which affect the precipitation amount of the carbonitrides which precipitate in the grain boundaries. Thus, since the usage environment such as operating temperature in the plant is predetermined, it is possible to control the carbonitrides which precipitate during the usage in the plant by controlling the average grain size after solution treatment and the chemical composition of the γ' hardened Ni-based alloy.

(c) In addition to the area fraction ρ, intragranular strengthening is also an important factor in order to improve the ductility and to suppress the reheat cracking.

(d) It is possible to quantify the intragranular strengthening by amounts of Al, Ti, and Nb which are γ' stabilizer and are included with Ni in γ' phase. Thus, since the usage environment such as operating temperature in the plant is predetermined, it is possible to control γ' phase which precipitate during the usage in the plant by controlling the chemical composition of the γ' hardened Ni-based alloy.

(e) As a result of investigating the relation between the area fraction ρ, the average grain size, and the intragranular strengthening in detail, it is found that the area fraction ρ which is minimum-required to improve the ductility and to suppress the reheat cracking changes depending on the average grain size and the intragranular strengthening. Thus, by comprehensively controlling the chemical composition, the average grain size, and the area fraction ρ, it is possible to obtain the γ' hardened Ni-based alloy which is excellent in the creep rupture time, the creep rupture ductility, and the reheat cracking resistance.

(f) Moreover, in order to segregate B which promotes the grain boundary precipitation of the carbonitrides to the grain boundaries in advance of P, P content needs to be f1 or less, when f1 is expressed by a following Expression A using B content (mass %)

$$f1=0.01-0.012/[1+\exp\{(B-0.0015)/0.001\}] \quad \text{(Expression A)}$$

(g) Moreover, when precipitates with a major axis of 100 nm or more exist in metallographic structure of the γ' hardened Ni-based alloy after the solution treatment, coarse precipitates increase during the usage in the plant, and as a result, the creep rupture strength decreases. Thus, it is preferable that the precipitates with the major axis of 100 nm or more are absent in the metallographic structure after the solution treatment.

The present invention has been completed based on these findings. An aspect of the present invention employs the following (1) to (6).

(1) A Ni-based alloy according to an aspect of the present invention includes, as a chemical composition, by mass %, 0.001% to 0.15% of C,
0.01% to 2% of Si,
0.01% to 3% of Mn,
15% to less than 28% of Cr,
3% to 15% of Mo,
more than 5% to 25% of Co,
0.2% to 2% of Al,
0.2% to 3% of Ti,
0.0005% to 0.01% of B,
0% to 3.0% of Nb,
0% to 15% of W,
0% to 0.2% of Zr,
0% to 1% of Hf,
0% to 0.05% of Mg,
0% to 0.05% of Ca,
0% to 0.5% of Y,
0% to 0.5% of La,
0% to 0.5% of Ce,
0% to 0.5% of Nd,
0% to 8% of Ta,
0% to 8% of Re,
0% to 15% of Fe,
f1 expressed by a following Expression 1 or less of P,
0.01% or less of S, and
a balance consisting of Ni and impurities, wherein, when an average grain size d is an average grain size in unit of μm of a γ phase included in a metallographic structure of the Ni-based alloy, the average grain size d is 10 μm to 300 μm, wherein precipitates with a major axis of 100 nm or more are absent in the metallographic structure, and wherein, when an area fraction ρ is expressed by a following Expression 2 using the average grain size d and amounts in unit of mass % of each element in the chemical composition, the area fraction ρ is f2 expressed by a following Expression 3 or more.

$$f1=0.01-0.012/[1+\exp\{(B-0.0015)/0.001\}] \quad \text{(Expression 1)}$$

$$\rho=21\times d_{0.3}^{0.15}+40\times(500\times B/10.81+50\times C/12.01+Cr/52.00) \quad \text{(Expression 2)}$$

$$f2=32\times d^{0.07}+115\times(Al/26.98+Ti/47.88+Nb/92.91)^{0.5} \quad \text{(Expression 3)}$$

(2) The Ni-based alloy according to (1) may include, as the chemical composition, by mass %, 0.05% to 3.0% of Nb.

(3) The Ni-based alloy according to (1) or (2) may include, as the chemical composition, by mass %, 1% to 15% of W.

(4) The Ni-based alloy according to any one of (1) to (3) may include, as the chemical composition, by mass %, 0.005% to 0.2% of Zr,
0.005% to 1% of Hf,
0.0005% to 0.05% of Mg,
0.0005% to 0.05% of Ca,
0.0005% to 0.5% of Y,
0.0005% to 0.5% of La,
0.0005% to 0.5% of Ce,
0.0005% to 0.5% of Nd,
0.01% to 8% of Ta,
0.01% to 8% of Re, and
1.5% to 15% of Fe.

(5) A Ni-based alloy tube according to an aspect of the present invention includes a Ni-based alloy according to any one of (1) to (4) for a production thereof.

Effects of Invention

The Ni-based alloy according to the above aspects of the present invention is the alloy in which the ductility (creep rupture ductility) after the usage for the long time in the high-temperature is drastically improved and the reheat cracking or the like which may occur at welding for repair or the like is suppressed. In other words, in the Ni-based alloy according to the above aspect of the present invention, since γ' phase or the like does not precipitate before being installed in the plant, which is the solid solution state, the plastic deformability is excellent. In addition, since γ' phase or the like precipitates during the usage in the plant after being installed in the plant, the high temperature strength (creep rupture time) increases. Also, since the carbonitrides preferably precipitate, the creep rupture ductility and the reheat cracking resistance are high. Thus, it is possible to appropriately apply the Ni-based alloy to plates, bars, forgings, or the like which are used as alloy tubes and heat resisting and pressure resisting materials in boilers for power generating plants, chemical industrial plants, or the like.

DETAILED DESCRIPTION OF PREFERRED EMBODIMENTS

Hereinafter, a preferable embodiment of the present invention will be described in detail. First, a chemical composition of a Ni-based alloy according to the embodiment will be described.

1. Chemical Component (Chemical Composition) of Alloy

Limitation reasons of each element are as follows. Hereinafter, "%" of the amount of respective elements as described below expresses "mass %". Moreover, the limitation range of respective elements as described below includes a lower limit and an upper limit thereof. However, the limitation range in which the lower limit is shown as "more than" does not include the lower limit, and the limitation range in which the upper limit is shown as "less than" does not include the upper limit.

The Ni-based alloy according to the embodiment includes, as base elements, C, Si, Mn, Cr, Mo, Co, Al, Ti, and B.

C: 0.001% to 0.15%

Carbon (C) is an important element which characterizes the embodiment with below mentioned P, Cr, and B. Specifically, C is the element which affects an area fraction ρ by forming carbonitrides. Moreover, C is the element which is effective in ensuring creep rupture strength (creep rupture time) and tensile strength that are necessary to be used in the environment such as high-temperature. However, when more than 0.15% of C is included, an amount of insoluble carbonitrides increases in a solid solution state, and as a result, not only C does not contribute to the improvement in high temperature strength but also C deteriorates mechanical properties such as toughness and weldability. Thus, C content is to be 0.15% or less. C content is preferably 0.1% or less. In addition, when C content is less than 0.001%, the precipitation of the carbonitrides which occupy the grain boundaries may be insufficient. Thus, in order to obtain the above effects, C content is to be 0.001% or more. C content is preferably 0.005% or more, is further preferably 0.01% or more, and is much further preferably 0.02% or more.

Si: 0.01% to 2%

Si (silicon) is included as a deoxidizing element. However, when more than 2% of Si is included, the weldability and hot workability decrease. Also, the toughness and ductility decrease because of the deterioration of microstructural stability in the high-temperature by promoting the formation of intermetallic compounds such as σ phase. Thus, Si content is to be 2% or less. Si content is preferably 1.0% or less and is further preferably 0.8% or less. In addition, in order to obtain the above effects, Si content is to be 0.01% or more. Si content is preferably 0.05% or more and is further preferably 0.1% or more.

Mn: 0.01% to 3%

Mn (manganese) has a deoxidizing effect in common with Si. Also, Mn has an effect in improving the hot workability by fixing S which is included as an impurity in the alloy as sulfides. However, when Mn content is excessive, the formation of spinel type oxide films is promoted, and as a result, oxidation resistance in the high-temperature decreases. Thus, Mn content is to be 3% or less. Mn content is preferably 2.0% or less and is further preferably 1.0% or less. In addition, in order to obtain the above effects, Mn content is to be 0.01% or more. Mn content is preferably 0.05% or more and is further preferably 0.08% or more.

Cr: 15% to less than 28%

Cr (chromium) is an important element which characterizes the embodiment with the above mentioned C and the below mentioned P and B. Specifically, Cr is the element which affects the area fraction ρ. Moreover, Cr is the important element which is more effective in improving corrosion resistance such as the oxidation resistance, steam oxidation resistance, and high temperature corrosion resistance. However, when Cr content is less than 15%, the above intended effects are not obtained. On the other hand, when Cr content is 28% or more, the hot workability decreases and the microstructural stability deteriorates by precipitating σ phase. Thus, Cr content is to be 15% or more and less than 28%. Cr content is preferably 18% or more, is further preferably 20% or more, and is most preferably more than 24%. Cr content is preferably 26% or less and is further preferably 25% or less.

Mo: 3% to 15%

Mo (molybdenum) has effects in increasing the creep rupture strength by being solid-soluted into matrix and in decreasing linear expansion coefficient. In order to obtain the above effects, 3% or more of Mo need to be included. However, when Mo content is more than 15%, the hot workability and the microstructural stability decrease. Thus, Mo content is to be 3% to 15%. Mo content is preferably 4% or more and is further preferably 5% or more. Mo content is preferably 14% or less and is further preferably 13% or less.

Co: more than 5% to 25%

Co (cobalt) has an effect in increasing the creep rupture strength by being solid-soluted into the matrix. Also, Co has an effect in further increasing the creep rupture strength by increasing the precipitation amount of γ' phase in a temperature range of 750° C. or more in particular. In order to obtain the above effects, more than 5% of Co need to be included. However, when Co content is more than 25%, the hot workability decreases. Thus, Co content is to be more than 5% and 25% or less. In a case where the balance between the hot workability and the creep rupture strength is regarded as important, Co content is preferably 7% or more and is further preferably 8% or more. Also, Co content is preferably 20% or less and is further preferably 15% or less.

Al: 0.2% to 2%

Al (aluminum) is an important element which precipitates γ' phase ($Ni_3Al$) that is the intermetallic compound in the Ni-based alloy and which considerably increases the creep rupture strength. In order to obtain the above effects, 0.2% or more of Al need to be included. However, when Al content is more than 2%, the hot workability decreases, and it is difficult to conduct hot forging and hot tubemaking. In addition, when Al content is more than 2%, creep rupture ductility and reheat cracking resistance may decrease. Thus, Al content is to be 0.2% to 2%. Al content is preferably 0.8% or more and is further preferably 0.9% or more. Al content is preferably 1.8% or less and is further preferably 1.7% or less.

Ti: 0.2% to 3%

Ti (titanium) is an important element which precipitates γ' phase ($Ni_3(Al,Ti)$) that is the intermetallic compound with Al in the Ni-based alloy and which considerably increases the creep rupture strength. In order to obtain the above effects, 0.2% or more of Ti need to be included. However, when Ti content is more than 3%, the hot workability decreases, and it is difficult to conduct the hot forging and the hot tubemaking. In addition, when Ti content is more than 3%, the creep rupture ductility and the reheat cracking resistance may decrease. Thus, Ti content is to be 0.2% to 3%. Ti content is preferably 0.3% or more and is further preferably 0.4% or more. Ti content is preferably 2.8% or less and is further preferably 2.6% or less.

B: 0.0005% to 0.01%

B (boron) is an important element which characterizes the embodiment with the above mentioned C and Cr and the below mentioned P. Specifically, B is the element which is included in the carbonitrides with C and N and which affects the area fraction ρ. Moreover, B has an effect in increasing the creep rupture strength by promoting the fine and dispersive precipitation of the carbonitrides. Furthermore, B has an effect in drastically increasing the creep rupture strength, the creep rupture ductility, and the hot workability in a lower temperature range such as approximately 1000° C. or less for the Ni-based alloy according to the embodiment. In order to obtain the above effects, 0.0005% or more of B need to be included. On the other hand, when B content is excessive, in particular, when B content is more than 0.01%, the hot workability decreases in addition to a decrease in the weldability. Thus, B content is to be 0.0005% to 0.01%. B content is preferably 0.001% or more. B content is preferably 0.008% or less and is further preferably 0.006% or less.

The Ni-based alloy according to the embodiment includes the above mentioned elements and the below mentioned optional elements, and the balance consists of Ni and impurities. Next, Ni included as the balance of the Ni-based alloy according to the embodiment will be described.

Ni (nickel) is an important element which stabilizes γ phase having fcc (face centered cubic) structure and which ensure the corrosion resistance. In the embodiment, Ni content does not need to be particularly limited. Ni content may be the content obtained by removing the impurity content from the balance. Ni content in the balance is preferably more than 50% and further preferably more than 60%.

Next, the impurities included as the balance of the Ni-based alloy according to the embodiment will be described. Herein, "impurities" represent elements which are contaminated during industrial production of the Ni-based alloy from ores and scarp that are used as a raw material or from environment of a production process. Among the impurities, it is preferable that P and S are limited to the following in order to sufficiently obtain the above mentioned effects. Moreover, since it is preferable that the amount of respective impurities is low, a lower limit does not need to be limited, and the lower limit of the respective impurities may be 0%.

P: limited to f1 or less, f1 being expressed by a following Expression A

P (phosphorus) is a noticeable element which characterizes the embodiment with the above mentioned C, Cr, and B. Specifically, P is included as the impurity in the alloy, and the weldability and the hot workability drastically decrease when P is excessively included. Moreover, P tends to segregate to the grain boundaries in advance of B which let the carbonitrides precipitate finely and dispersedly. Thereby, the formation of precipitates is suppressed, and the creep rupture strength, the creep rupture ductility, and the reheat cracking resistance decrease. Thus, P content needs to be limited in proportion as B content. Specifically, P content needs to be limited to f1 or less when f1 is expressed by a following Expression A. It is preferable to control P content as low as possible, and P content is preferably 0.008% or less.

$$f1=0.01-0.012/[1+\exp\{(B-0.0015)/0.001\}] \quad \text{(Expression A)}$$

S: limited to 0.01% or less

S (sulfur) is included as the impurity in the alloy in common with P. When S is excessively included, the weldability and the hot workability drastically decrease. Thus, S content is limited to 0.01% or less. In a case where the hot workability is regarded as important, S content is preferably 0.005% or less and is further preferably 0.003% or less.

In addition, N (nitrogen) is included as an impurity in the Ni-based alloy according to the embodiment. However, even if the Ni-based alloy includes N which is contaminated as the impurity by ordinary producing condition, the above mentioned effects of the Ni-based alloy according to the embodiment are not affected. Thus, N content does not need to be particularly limited. Although N included as the impurity bonds to other elements to form the carbonitrides in the alloy, the amount of N which is contaminated as the impurity does not affect the formation of the carbonitrides.

Thus, it is not necessary to take account of N content in order to control the carbonitrides. In order to preferably control the formation of the carbonitrides, N content may be 0.03% or less.

In substitution for a part of the above mentioned Ni, the Ni-based alloy according to the embodiment may further include at least one optional element selected from the group consisting of Nb, W, Zr, Hf, Mg, Ca, Y, La, Ce, Nd, Ta, Re, and Fe whose contents are mentioned below. The optional elements may be included as necessary. Thus, a lower limit of the respective optional elements does not need to be limited, and the lower limit may be 0%. Moreover, even if the optional elements may be included as impurities, the above mentioned effects are not affected.

Nb: 0% to 3.0%

Nb (niobium) has an effect in increasing the creep rupture strength. Since Nb has the effect in increasing the creep rupture strength by forming γ' phase that is the intermetallic compound with Al and Ti, Nb may be included as necessary. However, when more than 3.0% of Nb is included, the hot workability and the toughness decrease. Moreover, Nb content is more than 3.0%, the creep rupture ductility and the reheat cracking resistance may decrease. Thus, Nb content may be 0% to 3.0% as necessary. Nb content is preferably 2.5% or less. In order to stably obtain the above effects, Nb content is preferably 0.05% or more and is further preferably 0.1% or more.

W: 0% to 15%

W (tungsten) has an effect in increasing the creep rupture strength. Since W has the effect in increasing the creep rupture strength by being solid-soluted into the matrix as a solid solution hardening element, W may be included as necessary. Although Mo is included as one of the base elements in the embodiment, it is possible to obtain the preferable properties for zero ductility temperature and the hot workability in a higher temperature range such as approximately 1150° C. or more by including W as compared with the same Mo equivalent. Thus, in order to ensure the hot workability in the higher temperature range, it is preferable that W is included. Moreover, although Mo and W are solid-soluted into γ' phase which precipitates by including Al and Ti, W tends to be sufficiently solid-soluted into γ' phase as compared with the same Mo equivalent, and thereby, it is possible to suppress γ' phase coarsening during the usage for the long time. Thus, in order to stably ensure the high creep rupture strength for the long time in the high-temperature, it is preferable that W is included. Thus, W content may be 0% to 15% as necessary. In order to stably obtain the above effects, W content is preferably 1% or more and is further preferably 1.5% or more.

Any one or two of the above-mentioned Nb and W may be included. In a case where the elements are simultaneously included, total amount is preferably 6% or less.

<1>

Zr: 0% to 0.2%

Hf: 0% to 1%

Each of Zr and Hf of the <1> group has an effect in increasing the creep rupture strength. Thus, the elements may be included as necessary.

Zr: 0% to 0.2%

Zr (zirconium) is an element which strengthens the grain boundaries and has the effect in increasing the creep rupture strength. Also, Zr has an effect in increasing the creep rupture ductility. Thus, Zr may be included as necessary. However, when Zr content is excessive and is more than 0.2%, the hot workability may decrease. Thus, Zr content may be 0% to 0.2% as necessary. Zr content is preferably 0.1% or less and is further preferably 0.05% or less. On the other hand, in order to stably obtain the above effects, Zr content is preferably 0.005% or more and is further preferably 0.01% or more.

Hf: 0% to 1%

Hf (hafnium) mainly contributes to the grain boundary strengthening and has the effect in increasing the creep rupture strength. Thus, Hf may be included as necessary. However, when Hf content is more than 1%, the workability and the weldability may decrease. Thus, Hf content may be 0% to 1% as necessary. Hf content is preferably 0.8% or less and is further preferably 0.5% or less. On the other hand, in order to stably obtain the above effects, Hf content is preferably 0.005% or more, is further preferably 0.01% or more, and is furthermore preferably 0.02% or more.

Any one or two of the above-mentioned Zr and Hf may be included. In a case where the elements are simultaneously included, total amount is preferably 0.8% or less.

<2>

Mg: 0% to 0.05%

Ca: 0% to 0.05%

Y: 0% to 0.5%

La: 0% to 0.5%

Ce: 0% to 0.5%

Nd: 0% to 0.5%

Each of Mg, Ca, Y, La, Ce, and Nd of the <2> group has an effect in increasing the hot workability by fixing S as the sulfides. Thus, the elements may be included as necessary.

Mg: 0% to 0.05%

Mg (magnesium) has an effect in improving the hot workability by fixing S which deteriorates the hot workability as sulfides. Thus, Mg may be included as necessary. However, when Mg content is more than 0.05%, material properties may deteriorate. Specifically, the hot workability and the ductility may decrease. Thus, Mg content may be 0% to 0.05% as necessary. Mg content is preferably 0.02% or less and is further preferably 0.01% or less. On the other hand, in order to stably obtain the above effects, Mg content is preferably 0.0005% or more and is further preferably 0.001% or more.

Ca: 0% to 0.05%

Ca (calcium) has an effect in improving the hot workability by fixing S which deteriorates the hot workability as sulfides. Thus, Ca may be included as necessary. However, when Ca content is more than 0.05%, the material properties may deteriorate. Specifically, the hot workability and the ductility may decrease. Thus, Ca content may be 0% to 0.05% as necessary. Ca content is preferably 0.02% or less and is further preferably 0.01% or less. On the other hand, in order to stably obtain the above effects of Ca, Ca content is preferably 0.0005% or more and is further preferably 0.001% or more.

Y: 0% to 0.5%

Y (yttrium) has an effect in improving the hot workability by fixing S as sulfides. Moreover, Y has effects in improving adhesiveness of a $Cr_2O_3$ protective film on the alloy surface and in improving the oxidation resistance at cyclic oxidation. Furthermore, Y contributes to the grain boundary strengthening and has an effect in increasing the creep rupture strength and the creep rupture ductility. Thus, Y may be included as necessary. However, when Y content is more than 0.5%, inclusions such as oxides may be excessive, and thereby, the workability and the weldability may decrease. Thus, Y content may be 0% to 0.5% as necessary. Y content is preferably 0.3% or less and is further preferably 0.15% or less. On the other hand, in order to stably obtain the above effects, Y content is preferably 0.0005% or more, is further preferably 0.001% or more, and is furthermore preferably 0.002% or more.

La: 0% to 0.5%

La (lanthanum) has an effect in improving the hot workability by fixing S as sulfides. Moreover, La has effects in improving the adhesiveness of the $Cr_2O_3$ protective film on the alloy surface and in improving the oxidation resistance at the cyclic oxidation. Furthermore, La contributes to the grain boundary strengthening and has an effect in increasing the creep rupture strength and the creep rupture ductility. Thus, La may be included as necessary. However, when La content is more than 0.5%, the inclusions such as oxides may be excessive, and thereby, the workability and the weldability may decrease. Thus, La content may be 0% to 0.5% as necessary. La content is preferably 0.3% or less and is further preferably 0.15% or less. On the other hand, in order to stably obtain the above effects, La content is preferably 0.0005% or more, is further preferably 0.001% or more, and is furthermore preferably 0.002% or more.

Ce: 0% to 0.5%

Ce (cerium) has an effect in improving the hot workability by fixing S as sulfides. Moreover, Ce has effects in improving the adhesiveness of the $Cr_2O_3$ protective film on the alloy surface and in improving the oxidation resistance at the cyclic oxidation. Furthermore, Ce contributes to the grain boundary strengthening and has an effect in increasing the creep rupture strength and the creep rupture ductility. Thus, Ce may be included as necessary. However, when Ce content is more than 0.5%, the inclusions such as oxides may be excessive, and thereby, the workability and the weldability may decrease. Thus, Ce content may be 0% to 0.5% as necessary. Ce content is preferably 0.3% or less and is further preferably 0.15% or less. On the other hand, in order to stably obtain the above effects, Ce content is preferably 0.0005% or more, is further preferably 0.001% or more, and is furthermore preferably 0.002% or more.

Nd: 0% to 0.5%

Nd (neodymium) is an element which is more effective in suppressing the reheat cracking and in increasing the ductility (creep rupture ductility) after the usage for the long time in the high-temperature for the Ni-based alloy according to the embodiment. Thus, Nd may be included as necessary. However, when Nd content is more than 0.5%, the hot workability may decrease. Thus, Nd content may be 0% to 0.5% as necessary. Nd content is preferably 0.3% or less and is further preferably 0.15% or less. On the other hand, in order to stably obtain the above effects, Nd content is preferably 0.0005% or more, is further preferably 0.001% or more, and is furthermore preferably 0.002% or more.

Any one or two or more of the above-mentioned Mg, Ca, Y, La, Ce, and Nd may be included. In a case where the elements are simultaneously included, total amount is preferably 0.5% or less. In general, Y, La, Ce, and Nd may be included in misch metals. Thus, the above-mentioned amount of Y, La, Ce, and Nd may be supplied as the state of the misch metals.

<3>

Ta: 0% to 8%

Re: 0% to 8%

Each of Ta and Re of the <3> group act as the solid solution hardening element and has an effect in increasing the high temperature strength, specifically, the creep rupture strength. Thus, the elements may be included as necessary.

Ta: 0% to 8%

Ta (tantalum) forms the carbonitrides and has an effect in increasing the high temperature strength, specifically, the creep rupture strength as the solid solution hardening element. Thus, Ta may be included as necessary. However, when Ta content is more than 8%, the workability and the mechanical properties may decrease. Thus, Ta content may be 0% to 8% as necessary. Ta content is preferably 7% or less and is further preferably 6% or less. On the other hand, in order to stably obtain the above effects, Ta content is preferably 0.01% or more, is further preferably 0.1% or more, and is furthermore preferably 0.5% or more.

Re: 0% to 8%

Re (rhenium) has an effect in increasing the high temperature strength, specifically, the creep rupture strength as mainly the solid solution hardening element. Thus, Re may be included as necessary. However, when Re content is more than 8%, the workability and the mechanical properties may decrease. Thus, Re content may be 0% to 8% as necessary. Re content is preferably 7% or less and is further preferably 6% or less. On the other hand, in order to stably obtain the above effects, Re content is preferably 0.01% or more, is further preferably 0.1% or more, and is furthermore preferably 0.5% or more.

Any one or two of the above-mentioned Ta and Re may be included. In a case where the elements are simultaneously included, total amount is preferably 8% or less.

<4>

Fe: 0% to 15%

Fe (iron) has an effect in improving the hot workability for the Ni-based alloy according to the embodiment. Thus, Fe may be included as necessary. In addition, approximately 0.5% to 1% of Fe may be included as the impurity by contamination from a furnace wall, which derived from dissolving Fe-based alloy in actual production process. When Fe content is more than 15%, the oxidation resistance and the microstructural stability may decrease. Thus, Fe content may be 0% to 15% as necessary. In a case where the oxidation resistance is regarded as important, Fe content is preferably 10% or less. In order to obtain the above effects, Fe content is preferably 1.5% or more, is further preferably 2.0% or more, and is furthermore preferably 2.5% or more.

Next, a metallographic structure of the Ni-based alloy according to the embodiment will be described.

The Ni-based alloy according to the embodiment includes the metallographic structure which corresponds to supersaturated solid solution obtained by water-cooled after solution treatment.

2. Grain Size of Alloy

Average grain size d of γ phase is 10 μm to 300 μm

The average grain size of γ phase is an important factor which characterizes the embodiment. Specifically, the average grain size is the factor which affects the area fraction ρ in connection with the formation of the carbonitrides. The average grain size is the controllable factor by controlling the conditions of the solution heat treatment. In addition, the average grain size is the factor which is effective in ensuring the creep rupture strength and the tensile strength that are necessary to be used in the environment such as high-temperature. When the average grain size d is less than 10 μm, total area of grain boundaries is excessive. Thus, the area fraction ρ decreases, and as a result, the above intended effects are not obtained. Qualitatively, it can be explained that, when the average grain size d is less than 10 μm, the grain boundary strengthening is insufficient because the total area of grain boundaries is excessive even if the carbonitrides precipitate in the grain boundaries during the usage in the plant. On the other hand, when the average grain size d is more than 300 μm, the grain size is excessively coarse. Thus, the ductility, the toughness, and the hot workability decrease in the high-temperature regardless of the area fraction ρ. Therefore, when the average grain size of γ phase is defined as d in μm, the average grain size d is to be 10 μm to 300 μm. The average grain size d is preferably 30 μm or more and is further preferably 50 μm or more. Moreover, the average grain size d is preferably 270 μm or less and is further preferably 250 μm or less.

3. Precipitates with a Major Axis of 100 nm or More

It is preferable that the precipitates with the major axis of 100 nm or more are absent in the metallographic structure after the solution treatment. When the precipitates with the major axis of 100 nm or more are subsistent in the (intragranular) metallographic structure after the solution treatment, the carbonitrides coarsen during the usage in the plant. As a result, the creep rupture strength of the Ni-based alloy may decrease. In order not to precipitate the carbonitrides with the major axis of 100 nm or more in the metallographic structure after the solution treatment, it is needed to quicken a cooling rate during water cooling after the solution treatment. For example, when the cooling rate is slower than 1° C./sec, the coarse carbonitrides (100 nm or more) may precipitate.

The conditions of production process to control the average grain size d of γ phase and the number of the precipitates with the major axis of 100 nm or more will be described below in detail 4. Area Fraction ρ

Area fraction ρ: f2 or more, f2 being expressed by a following Expression C

The area fraction ρ represents an index which estimates the area fraction (%) of the grain boundaries covered by the carbonitrides which precipitate in the grain boundaries during the usage in the plant with respect to the total grain boundaries. Since the usage environment such as operating temperature in the plant is predetermined, the carbonitrides which precipitate in the grain boundaries during the usage in the plant comply with the area fraction ρ by controlling an initial state of the Ni-based alloy according to the embodiment. In other word, it is signified that the carbonitrides which precipitate in the grain boundaries during the usage in the plant can be controlled by controlling the initial state such as the chemical composition and the average grain size d. The area fraction ρ is expressed by a following Expression B using the average grain size d and amounts in mass % of each element in the chemical composition. As shown in the Expression B, the area fraction ρ is a value which is quantitatively obtained by the average grain size d (μm) and the amounts (mass %) of B, C, and Cr which affect the precipitation amount of the carbonitrides which precipitate in the grain boundaries. In order to suppress the reheat cracking and to increase the ductility (creep rupture ductility) after the usage for the long time in the high-temperature for the Ni-based alloy according to the embodiment, it is needed to control the area fraction ρ to be the predetermined value or more. Specifically, the area fraction ρ needs to be f2 or more when f2 is expressed by the following Expression C. In addition, f2 is a value which is obtained by the average grain size d (μm) and the amounts (mass %) of Al, Ti, and/or Nb which affect intragranular strengthening. When Nb which is the optional element is not included, zero is substituted for Nb in the following Expression C. Although an upper limit of the area fraction ρ does not need to be particularly limited, the area fraction ρ may be 100 as necessary.

$$\rho=21\times d^{0.15}+40\times(500\times B/10.81+50\times C/12.01+Cr/52.00) \quad \text{(Expression B)}$$

$$f2=32\times d^{0.07}+115\times(Al/26.98+Ti/47.88+Nb/92.91)^{0.5} \quad \text{(Expression C)}$$

In the Ni-based alloy according to the embodiment, by simultaneously controlling the chemical composition, the average grain size d of γ phase, the number of the precipitates with the major axis of 100 nm or more, and the area fraction ρ as mentioned above, it is possible to obtain the Ni-based alloy which is excellent in the plastic deformability before being installed in the plant because of the solid solution state where γ' phase or the like does not precipitate, is excellent in the high temperature strength (creep rupture time) because γ' phase or the like precipitates during the usage in the plant after being installed in the plant, and is excellent in the creep rupture ductility and the reheat cracking resistance because the carbonitrides preferably precipitate.

The above mentioned γ' phase has an $L1_2$ ordered structure and coherently precipitates in γ phase which is the matrix of the Ni-based alloy according to the embodiment. Since a coherent interface between γ phase which is the matrix and γ' phase which is the coherent precipitate acts as a dislocation barrier, the high temperature strength increases. The tensile strength of the Ni-based alloy according to the embodiment in which γ' phase does not precipitate is approximately 600 MPa to 900 MPa at room temperature. The tensile strength of the Ni-based alloy in which γ' phase precipitates is approximately 800 MPa to 1200 MPa at the room temperature.

In the Ni-based alloy according to the embodiment, by the carbonitrides and γ' phase which precipitate during an isothermal holding at 600° C. to 750° C. which corresponds to the usage environment in the plant, the creep rupture time, the creep rupture ductility, and the reheat cracking resistance preferably increase. Although the details are not clear yet, it seem that the above effects are obtained because the carbonitrides and γ' phase which precipitate during the isothermal holding at 600° C. to 750° C. are finely dispersed as compared with carbonitrides and γ' phase which precipitate in the high-temperature.

The above mentioned average grain size d of γ phase may be measured by the following method. An arbitrary part of test specimen is cut so that an observed section corresponds to a cross section which is parallel to a longitudinal direction of rolling. The observed section of the test specimen which is embedded in resin is mirror-polished. The polished section is etched by mixed acid or kalling's reagent. The observed section which was etched is observed with an optical microscope or a scanning electron microscope. In order to determine the average grain size d, micrographs of five visual fields are taken at a magnification of 100-fold, intercept lengths of grains are measured by an intercept method in total four directions which are vertical (perpendicular to the rolling direction), horizontal (parallel to the rolling direction), and two diagonal lines on each visual field, and thereby, the average grain size d (μm) is calculated by multiplying the measured value by 1.128. In addition, existence of the precipitates with the major axis of 100 nm or more in the (intragranular) metallographic structure may be identified by observing bright fields of an arbitrary area of the test specimen at a magnification of 50000-fold using a transmission electron microscope. Moreover, the major axis is defined as the longest segment among segments which link vertexes that do not adjoin each other in a contour of the precipitates on the observed section.

Next, a method of producing the Ni-based alloy according to the embodiment will be described.

In order to produce the Ni-based alloy according to the embodiment, it is preferable that a solution treatment process is controlled. Processes except the solution treatment process are not particularly limited. For example, the Ni-based alloy according to the embodiment may be produced as follows. As a casting process, the Ni-based alloy which consists of the above mentioned chemical composition is melted and cast. In the casting process, it is preferable to use a high-frequency vacuum induction furnace. As a hot-working process, the cast piece after the casting process is hot-worked. In the hot-working process, it is preferable that hot-working start temperature is in a temperature range of 1100° C. to 1190° C., hot-working finish temperature is in a temperature range of 900° C. to 1000° C., and cumulative reduction is 50% to 99%. Also, in the hot-working process, hot-rolling or hot-forging may be conducted. As a softening heat treatment process, the hot-worked piece after the hot-working process is subjected to the softening heat treatment. In the softening heat treatment process, it is preferable that softening heat treatment temperature is in a temperature range of 1100° C. to 1190° C. and a softening heat treatment time is 1 minute to 300 minutes. As a cold-working process, the softening-heat-treated piece after the softening heat treatment process is cold-worked. In the cold-working process, it is preferable that cumulative reduction is 20% to 99%. Also, in the cold-working process, cold-rolling or cold-forging may be conducted. Thereafter, as the solution treatment process, the cold-worked piece after the cold-working process is subjected to the solution treatment.

In the solution treatment process, it is preferable that solution treatment temperature is in a temperature range of 1160° C. to 1250° C., a solution treatment time is 1 minute to 300 minutes, and rapid cooling is conducted to room temperature at a cooling rate of 1° C./sec to 300° C./sec. By controlling the conditions of the solution treatment, it is possible to preferably control the average grain size d of γ phase and the number of the precipitates with the major axis of 100 nm or more. Specifically, it is possible to preferably control the number of the precipitates with the major axis of 100 nm or more by controlling the solution treatment temperature to be in the temperature range of 1160° C. to 1250° C. It is possible to preferably control the average grain size d of γ phase by controlling the solution treatment time to be 1 minute to 300 minutes. Moreover, it is possible to obtain the metallographic structure which corresponds to the supersaturated solid solution obtained by congealing the solution treated structure by the rapid cooling to the room temperature at the cooling rate of 1° C./sec or faster.

When the solution treatment temperature is lower than 1160° C., Cr-carbonitrides, other carbonitrides, or the like may remain in the metallographic structure, and thus, there is a possibility that the number of the precipitates with the major axis of 100 nm or more is not preferably controlled. In addition, from an industrial standpoint, it is difficult to control the solution treatment temperature to be 1250° C. or higher. The solution treatment temperature is preferably 1170° C. or higher and is further preferably 1180° C. or higher. Moreover, the solution treatment temperature is preferably 1230° C. or lower and is further preferably 1210° C. or lower.

When the solution treatment time is shorter than 1 minute, the solution treatment is insufficient. When the solution treatment time is longer than 300 minutes, there is a possibility that the average grain size d of γ phase is not preferably controlled. The solution treatment time is preferably 3 minutes or longer and is further preferably 10 minutes or longer. Moreover, the solution treatment time is preferably 270 minutes or shorter and is further preferably 240 minutes or shorter.

When the cooling rate is slower than 1° C./sec, there is a possibility that the metallographic structure which corresponds to the supersaturated solid solution is not obtained. In addition, from an industrial standpoint, it is difficult to control the cooling rate to be faster than 300° C./sec. The cooling rate is preferably 2° C./sec or faster, is further preferably 3° C./sec or faster, and is furthermore preferably 5° C./sec or faster. Moreover, an upper limit of the cooling rate does not need to be limited. In addition, the cooling rate represents a cooling rate on a surface of a water-cooled piece.

The shape of the Ni-based alloy produced by the above mentioned producing method is not particularly limited. For example, the shape may be a bar, a wire rod, a plate, or a tube. In a case where the Ni-based alloy is used as superheater tubes in boilers or chemical industrial reaction tubes, the tube shape is preferable. Specifically, the Ni-based alloy tube according to an embodiment of the present invention is made of the Ni-based alloy which satisfies the chemical composition, the average grain size d of γ phase, the number of the precipitates with the major axis of 100 nm or more, and the area fraction ρ as mentioned above.

Hereinafter, the effect of an aspect of the present invention will be described in detail with reference to the following example. However, the present invention is not limited to the example.

Example

Ni-based alloys of Nos. 1 to 17 and Nos. A to S that had chemical compositions shown in Table 1 and Table 2 were melted and cast by using the high-frequency vacuum induction furnace in order to obtain ingots of 30 kg. As shown in Table 1 and Table 2, since at least one of the elements in the chemical composition did not satisfy the target or P content was more than f1 in the alloy Nos. A, B, D to F, and H to R, the alloys were out of the range of the invention. In addition, the above f1 was calculated by the following Expression using the amounts in mass % of each element in the chemical composition. $f1=0.01-0.012/[1+\exp\{(B-0.0015)/0.001\}]$ In addition, in the Tables, underlined values indicate out of the range of the present invention. Also, in the Tables, blanks indicate that no optional element was intentionally added.

TABLE 1

| ALLOY | CHEMICAL COMPOSITION (MASS %. BALANCE CONSISTING OF Ni AND IMPURITIES) | | | | | | | | | | |
|---|---|---|---|---|---|---|---|---|---|---|---|
| NO. | C | Si | Mn | P | S | Cr | Mo | Co | Al | Ti | B |
| 1 | 0.038 | 0.15 | 0.16 | 0.0041 | 0.001 | 21.98 | 7.11 | 7.81 | 1.25 | 1.14 | 0.0052 |
| 2 | 0.022 | 0.17 | 0.17 | 0.0055 | 0.001 | 22.13 | 6.51 | 12.46 | 1.17 | 1.28 | 0.0071 |
| 3 | 0.046 | 0.11 | 0.11 | 0.0074 | 0.001 | 22.79 | 5.33 | 14.81 | 1.18 | 1.03 | 0.0039 |
| 4 | 0.035 | 0.20 | 0.12 | 0.0052 | 0.001 | 20.76 | 5.91 | 10.54 | 1.16 | 1.09 | 0.0068 |

TABLE 1-continued

| ALLOY | CHEMICAL COMPOSITION (MASS %. BALANCE CONSISTING OF Ni AND IMPURITIES) | | | | | | | | | | |
|---|---|---|---|---|---|---|---|---|---|---|---|
| NO. | C | Si | Mn | P | S | Cr | Mo | Co | Al | Ti | B |
| 5 | 0.031 | 0.19 | 0.19 | 0.0022 | 0.001 | 23.06 | 6.43 | 13.25 | 1.04 | 1.17 | 0.0028 |
| 6 | 0.063 | 0.11 | 0.21 | 0.0038 | 0.001 | 21.86 | 6.84 | 8.43 | 1.08 | 1.14 | 0.0071 |
| 7 | 0.052 | 0.12 | 0.10 | 0.0031 | 0.002 | 22.13 | 5.55 | 10.97 | 1.24 | 1.04 | 0.0084 |
| 8 | 0.039 | 0.17 | 0.12 | 0.0047 | 0.001 | 21.79 | 9.46 | 11.43 | 1.03 | 1.22 | 0.0046 |
| 9 | 0.028 | 0.14 | 0.11 | 0.0056 | 0.001 | 22.11 | 5.37 | 9.72 | 1.22 | 1.18 | 0.0092 |
| 10 | 0.032 | 0.18 | 0.14 | 0.0039 | 0.002 | 22.16 | 5.84 | 8.46 | 1.14 | 1.10 | 0.0058 |
| 11 | 0.047 | 0.16 | 0.19 | 0.0041 | 0.001 | 20.98 | 6.73 | 9.64 | 1.07 | 1.04 | 0.0060 |
| 12 | 0.069 | 0.16 | 0.16 | 0.0066 | 0.001 | 22.47 | 6.95 | 10.88 | 0.94 | 1.21 | 0.0043 |
| 13 | 0.035 | 0.18 | 0.13 | 0.0032 | 0.001 | 22.81 | 5.37 | 13.76 | 1.06 | 1.16 | 0.0088 |
| 14 | 0.042 | 0.18 | 0.13 | 0.0081 | 0.001 | 21.69 | 6.07 | 8.32 | 1.18 | 1.11 | 0.0069 |
| 15 | 0.046 | 0.10 | 0.10 | 0.0051 | 0.002 | 19.53 | 4.36 | 9.11 | 0.86 | 1.03 | 0.0021 |
| 16 | 0.031 | 0.25 | 0.11 | 0.0044 | 0.001 | 21.57 | 4.33 | 10.10 | 1.73 | 0.86 | 0.0031 |
| 17 | 0.051 | 0.11 | 0.15 | 0.0024 | 0.002 | 22.68 | 5.50 | 5.64 | 1.06 | 1.21 | 0.0046 |
| A | 0.023 | 0.14 | 0.17 | 0.0093 | 0.001 | 22.50 | 7.45 | 16.51 | 1.57 | 2.08 | 0.0011 |
| B | 0.024 | 0.19 | 0.18 | 0.0094 | 0.001 | 17.90 | 8.11 | 10.41 | 0.76 | 2.54 | 0.0009 |
| C | 0.041 | 0.24 | 0.15 | 0.0057 | 0.001 | 20.85 | 5.38 | 20.16 | 1.76 | 2.07 | 0.0024 |
| D | 0.058 | 0.13 | 0.16 | 0.0096 | 0.001 | 19.98 | 6.94 | 8.77 | 1.89 | 2.06 | 0.0041 |
| E | 0.024 | 0.09 | 0.16 | 0.0098 | 0.001 | 20.76 | 4.59 | 12.43 | 1.91 | 1.75 | 0.0028 |
| F | 0.029 | 0.17 | 0.16 | 0.0040 | 0.001 | 23.84 | 6.24 | 10.46 | 1.52 | 1.84 | 0.0014 |
| G | 0.61 | 0.15 | 0.14 | 0.0037 | 0.002 | 21.89 | 8.61 | 10.84 | 1.98 | 2.51 | 0.0017 |
| H | 0.0009 | 0.14 | 0.13 | 0.0032 | 0.002 | 20.51 | 5.47 | 10.56 | 1.56 | 1.30 | 0.0030 |
| I | 0.163 | 0.19 | 0.19 | 0.0043 | 0.001 | 23.19 | 5.19 | 11.84 | 1.48 | 1.23 | 0.0045 |
| J | 0.010 | 0.10 | 0.10 | 0.0051 | 0.002 | 14.90 | 4.36 | 9.11 | 1.64 | 2.01 | 0.0021 |
| K | 0.067 | 0.11 | 0.17 | 0.0057 | 0.002 | 20.98 | 5.96 | 3.10 | 0.86 | 1.39 | 0.0063 |
| L | 0.024 | 0.11 | 0.20 | 0.0061 | 0.001 | 24.80 | 6.71 | 0.28 | 0.85 | 1.57 | 0.0050 |
| M | 0.036 | 0.11 | 0.19 | 0.0022 | 0.001 | 23.49 | 5.81 | 8.46 | 0.17 | 0.98 | 0.0081 |
| N | 0.024 | 0.14 | 0.12 | 0.0078 | 0.001 | 21.10 | 6.13 | 20.43 | 2.01 | 1.90 | 0.0031 |
| O | 0.043 | 0.13 | 0.18 | 0.0091 | 0.001 | 22.87 | 4.83 | 10.39 | 0.86 | 0.19 | 0.0089 |
| P | 0.038 | 0.18 | 0.16 | 0.0035 | 0.001 | 22.01 | 3.58 | 10.64 | 1.52 | 3.02 | 0.0047 |
| Q | 0.031 | 0.21 | 0.17 | 0.0008 | 0.001 | 22.30 | 10.51 | 15.74 | 1.89 | 1.03 | 0.0004 |
| R | 0.032 | 0.20 | 0.10 | 0.0013 | 0.002 | 20.81 | 7.61 | 10.89 | 1.43 | 0.77 | 0.0012 |
| S | 0.040 | 0.16 | 0.20 | 0.0048 | 0.001 | 21.50 | 5.80 | 11.03 | 1.20 | 0.87 | 0.0031 |

*UNDERLINED VALUES INDICATE OUT OF THE RANGE OF THE PRESENT INVENTION IN THE TABLE.

TABLE 2

| ALLOY | CHEMICAL COMPOSITION (MASS %. BALANCE CONSISTING OF Ni AND IMPURITIES) | | | | | | | | | | | | | |
|---|---|---|---|---|---|---|---|---|---|---|---|---|---|---|
| NO. | Nb | W | Zr | Hf | Mg | Ca | Y | La | Ce | Nd | Ta | Re | Fe | f1 |
| 1 | | | | | | | | | | | | | | 0.0097 |
| 2 | | | | | | | | | | | | | | 0.0100 |
| 3 | 1.37 | | | | | | | | | | | | | 0.0090 |
| 4 | | | | | | | | | | | | | | 0.0099 |
| 5 | | | | | | | | | | | | | | 0.0074 |
| 6 | | | | | | | | | | | | | | 0.0100 |
| 7 | | 5.71 | | | | | | | | | | | | 0.0100 |
| 8 | | | | | | | | | | 0.029 | | | | 0.0095 |
| 9 | | | 0.031 | 0.19 | | | | | | | | | | 0.0100 |
| 10 | | | | | 0.0021 | | 0.017 | | | 0.031 | | | | 0.0098 |
| 11 | | | | | | 0.0038 | | 0.028 | | | | | 1.84 | 0.0099 |
| 12 | | | 0.028 | | | | | | | | 2.38 | | | 0.0093 |
| 13 | | | | | | | | | 0.0015 | | | | | 0.0100 |
| 14 | | | | | | | | | | | | 1.34 | 2.59 | 0.0099 |
| 15 | | | | | | | | | | | | | | 0.0057 |
| 16 | 0.04 | | | | | | | | | | | | | 0.0080 |
| 17 | | | | | | | | | | | | | | 0.0095 |
| A | | | | | | | | | | | | | | 0.0028 |
| B | | | | | | | | | | | | | | 0.0023 |
| C | | | | | | | | | | | | | | 0.0065 |
| D | | | | | | | | | | | | | | 0.0092 |
| E | | | | | | | | | | | | | | 0.0074 |
| F | | | | | | | | | | | | | | 0.0037 |
| G | | | | | | | | | | | | | | 0.0046 |
| H | | | | | | | | | | | | | | 0.0078 |
| I | | | | | | | | | | | | | | 0.0094 |
| J | | | | | | | | | | | | | | 0.0057 |
| K | | | | | | | | | | | | | | 0.0099 |
| L | | | | | | | | | | | | | | 0.0096 |
| M | | | | | | | | | | | | | | 0.0100 |
| N | | | | | | | | | | | | | | 0.0080 |
| O | | | | | | | | | | | | | | 0.0100 |
| P | | | | | | | | | | | | | | 0.0095 |

TABLE 2-continued

| ALLOY | CHEMICAL COMPOSITION (MASS %. BALANCE CONSISTING OF Ni AND IMPURITIES) | | | | | | | | | | | | | |
|---|---|---|---|---|---|---|---|---|---|---|---|---|---|---|
| NO. | Nb | W | Zr | Hf | Mg | Ca | Y | La | Ce | Nd | Ta | Re | Fe | f1 |
| Q | | | | | | | | | | | | | | 0.0010 |
| R | 3.10 | | | | | | | | | | | | | 0.0031 |
| S | | | | | | | | | | | | | | 0.0080 |

※UNDERLINED VALUES INDICATE OUT OF THE RANGE OF THE PRESENT INVENTION IN THE TABLE.
※BLANKS INDICATE THAT NO OPTIONAL ELEMENT IS INTENTIONALLY ADDED IN THE TABLE.

The above ingots were heated to 1160° C. and thereafter were subjected to the hot-forging under the condition such that the finish temperature was 1000° C. in order to obtain plates with a thickness of 15 mm. The plates with the thickness of 15 mm were subjected to the softening heat treatment at 1100° C. and thereafter were subjected to the cold-rolling until the thickness became 10 mm. The cold-rolled plates were subjected to the heat treatment as the solution treatment under the conditions shown in Table 3.

The metallographic structure was observed by using some of the plates with the thickness of 10 mm which were water-cooled after the solution treatment. Specifically, test specimen was cut so that an observed section corresponded to a cross section which was parallel to a longitudinal direction of rolling, the observed section of the test specimen which was embedded in resin was mirror-polished, the polished section was etched by mixed acid or kalling's reagent, and thereafter, the metallographic structure was observed. In order to determine the average grain size d, micrographs of five visual fields were taken at a magnification of 100-fold, intercept lengths of grains were measured by an intercept method in total four directions which were vertical (perpendicular to the rolling direction), horizontal (parallel to the rolling direction), and two diagonal lines on each visual field, and thereby, the average grain size d (μm) was calculated by multiplying the measured value by 1.128. In addition, test specimen for a transmission electron microscope was taken from an arbitrary area of the test specimen, and the existence of the precipitates with the major axis of 100 nm or more was identified by observing bright fields at a magnification of 50000-fold.

By using the obtained the average grain size d (μm) as mentioned above and the amounts in mass % of each element in the chemical composition, the calculations for the following Expressions were conducted, and thereby, the area fraction ρ (%) and f2 of each alloy were obtained.

$$\rho=21\times d^{0.15}+40\times(500\times B/10.81+50\times C/12.01+Cr/52.00)^{0.3}$$

$$f2=32\times d^{0.07}+115\times(Al/26.98+Ti/47.88+Nb/92.91)^{0.5}$$

In addition, for the alloys which did not include Nb, zero was substituted for Nb in the above Expression.

The average grain size d (μm), the existence of the precipitates with the major axis of 100 nm or more, the area fraction ρ (%), and f2 are shown in Table 3. As shown in Table 3, since ρ was less than f2 in the alloy Nos. A to H, J, N, and P to R, the alloys were out of the range of the invention. In addition, in the Table, underlined values indicate out of the range of the present invention.

TABLE 3

| | | CONDTIONS OF SOLUTION HEAT TREATMENT | | | AVERAGE | EXISTENCE OF | GRAIN | |
|---|---|---|---|---|---|---|---|---|
| TEST NO. | ALLOY NO. | TEMPERATURE (° C.) | T IME (min) | COOL ING RATE (° C./sec) | GRAIN SIZE d (μm) | PRECIPITATES WITH MAJOR AXIS OF 100 nm OR MORE | BOUNDARY OCCUPANCY INDEX ρ (%). | f2 |
| 1 | 1 | 1180 | 30 | 10 | 153 | NOT EXIST | 82.37 | 75.96 |
| 2 | 2 | 1180 | 10 | 10 | 127 | NOT EXIST | 81.47 | 75.37 |
| 3 | 3 | 1180 | 30 | 10 | 148 | NOT EXIST | 81.99 | 77.93 |
| 4 | 4 | 1180 | 60 | 10 | 198 | NOT EXIST | 84.64 | 75.83 |
| 5 | 5 | 1180 | 60 | 10 | 180 | NOT EXIST | 81.73 | 74.89 |
| 6 | 6 | 1180 | 10 | 10 | 86 | NOT EXIST | 81.10 | 72.76 |
| 7 | 7 | 1180 | 10 | 10 | 112 | NOT EXIST | 82.98 | 74.44 |
| 8 | 8 | 1180 | 30 | 10 | 165 | NOT EXIST | 82.50 | 74.76 |
| 9 | 9 | 1180 | 60 | 10 | 208 | NOT EXIST | 86.37 | 76.89 |
| 10 | 10 | 1180 | 60 | 10 | 185 | NOT EXIST | 83.74 | 75.49 |
| 11 | 11 | 1230 | 10 | 10 | 143 | NOT EXIST | 82.66 | 73.78 |
| 12 | 12 | 1230 | 3 | 10 | 79 | NOT EXIST | 79.43 | 71.64 |
| 13 | 13 | 1250 | 1 | 10 | 139 | NOT EXIST | 83.92 | 74.18 |
| 14 | 14 | 1160 | 30 | 10 | 129 | NOT EXIST | 82.43 | 74.72 |
| 15 | 15 | 1180 | 30 | 10 | 162 | NOT EXIST | 80.42 | 72.26 |
| 16 | 16 | 1180 | 10 | 10 | 103 | NOT EXIST | 77.83 | 77.30 |
| 17 | 17 | 1180 | 30 | 10 | 138 | NOT EXIST | 82.22 | 74.40 |
| 18 | A | 1180 | 60 | 10 | 213 | NOT EXIST | 80.89 | 83.24 |
| 19 | B | 1180 | 30 | 10 | 162 | NOT EXIST | 77.25 | 78.46 |
| 20 | C | 1180 | 30 | 10 | 138 | NOT EXIST | 79.65 | 83.05 |
| 21 | D | 1180 | 10 | 10 | 79 | NOT EXIST | 78.07 | 82.12 |
| 22 | E | 1180 | 60 | 10 | 208 | NOT EXIST | 81.57 | 84.17 |
| 23 | F | 1180 | 10 | 10 | 108 | NOT EXIST | 77.44 | 79.81 |
| 24 | G | 1180 | 10 | 10 | 82 | NOT EXIST | 77.42 | 84.35 |
| 25 | H | 1180 | 30 | 10 | 150 | NOT EXIST | 77.72 | 78.97 |
| 26 | I | 1180 | 30 | 10 | 145 | NOT EXIST | 87.90 | 77.97 |
| 27 | J | 1180 | 30 | 10 | 162 | NOT EXIST | 76.00 | 82.56 |

TABLE 3-continued

| TEST NO. | ALLOY NO. | CONDTIONS OF SOLUTION HEAT TREATMENT TEMPERATURE (° C.) | T IME (min) | COOL ING RATE (° C./sec) | AVERAGE GRAIN SIZE d (μm) | EXISTENCE OF PRECIPITATES WITH MAJOR AXIS OF 100 nm OR MORE | GRAIN BOUNDARY OCCUPANCY INDEX ρ (%). | f2 |
|---|---|---|---|---|---|---|---|---|
| 28 | K | 1180 | 30 | 10 | 159 | NOT EXIST | 84.60 | 74.01 |
| 29 | L | 1180 | 30 | 10 | 139 | NOT EXIST | 81.55 | 74.36 |
| 30 | M | 1180 | 60 | 10 | 185 | NOT EXIST | 85.66 | 64.93 |
| 31 | N | 1180 | 60 | 10 | 191 | NOT EXIST | 81.31 | 85.08 |
| 32 | O | 1180 | 60 | 10 | 187 | NOT EXIST | 86.39 | 67.92 |
| 33 | P | 1180 | 60 | 10 | 199 | NOT EXIST | 83.85 | 86.09 |
| 34 | Q | 1180 | 60 | 10 | 187 | NOT EXIST | 79.93 | 80.95 |
| 35 | R | 1180 | 10 | 10 | 96 | NOT EXIST | 75.77 | 80.86 |
| 36 | S | 1180 | 30 | 0.9 | 164 | EXIST | 81.42 | 74.51 |

※UNDERLINED VALUES INDICATE OUT OF THE RANGE OF THE PRESENT INVENTION IN THE TABLE.

By using remnant of the plates with the thickness of 10 mm which were water-cooled after the solution treatment, the mechanical properties were investigated. Specifically, a round-bar tensile test specimen with a diameter of 10 mm and a gage length of 30 mm was taken from a thickness central portion so as to be parallel to the longitudinal direction by machining. The round-bar tensile test specimen was subjected to a creep rupture test and a high temperature tensile test at a slow strain rate.

The creep rupture test was conducted by applying initial stress of 300 MPa at 700° C. to the round-bar tensile test specimen having the above mentioned shape, and the rupture time (creep rupture time) and rupture elongation (creep rupture ductility) were obtained. When the creep rupture time was 1500 hours or longer, the alloy was judged to be acceptable. When the rupture elongation was 15% or more, the alloy was judged to be acceptable.

The high temperature tensile test at the slow strain rate was conducted until rupture at a slow strain rate of $10^{-6}$/sec at 700° C. by using the round-bar tensile test specimen having the above mentioned shape, and reduction of area was obtained. When the reduction of area was 15% or more, the alloy was judged to be acceptable.

The above mentioned strain rate of $10^{-6}$/sec was ultra-slow and corresponded to 1/100 to 1/1000 as compared with a typical strain rate of high temperature tensile test. Thus, it was possible to relatively evaluate the reheat cracking sensitiveness by measuring the reduction of area obtained by the tensile test at the slow strain rate.

Specifically, when the reduction of area obtained by the tensile test at the slow strain rate was large, it was possible to judge the reheat cracking sensitiveness as small. In other word, it was possible to judge the suppression effects of the reheat cracking as large. The test results are shown in Table 4.

TABLE 4

| TEST NO. | ALLOY NO. | CREEP RUPTURE TEST UNDER 300 MPa AT 700° C. CREEP RUPTURE TIME (h) | ELONGATION AFTER CREEP FRACTURE (%) | TENSILE TEST UNDER ULTRA-SLOW STRAIN RATE AT 700° C. REDUCTION IN AREA AFTER FRACTURE (%) | REMARKS |
|---|---|---|---|---|---|
| 1 | 1 | 2037 | 41.4 | 45.2 | EXAMPLE |
| 2 | 2 | 1998 | 36.1 | 40.1 | |
| 3 | 3 | 2976 | 25.0 | 32.8 | |
| 4 | 4 | 2367 | 52.9 | 55.7 | |
| 5 | 5 | 2040 | 47.8 | 40.9 | |
| 6 | 6 | 1896 | 54.7 | 58.1 | |
| 7 | 7 | 3774 | 52.2 | 59.6 | |
| 8 | 8 | 3615 | 48.9 | 53.9 | |
| 9 | 9 | 1743 | 59.3 | 63.4 | |
| 10 | 10 | 2464 | 49.7 | 54.8 | |
| 11 | 11 | 2147 | 43.4 | 49.1 | |
| 12 | 12 | 1825 | 39.1 | 41.8 | |
| 13 | 13 | 2159 | 56.7 | 60.1 | |
| 14 | 14 | 2197 | 45.0 | 50.7 | |
| 15 | 15 | 1561 | 18.7 | 17.1 | |
| 16 | 16 | 1587 | 21.4 | 16.2 | |
| 17 | 17 | 1632 | 22.4 | 30.4 | |
| 18 | A | 558 | 4.1 | 3.4 | COMPARATIVE |
| 19 | B | 436 | 3.8 | 3.9 | EXAMPLE |
| 20 | C | 1429 | 13.4 | 10.8 | |
| 21 | D | 1027 | 6.7 | 5.1 | |
| 22 | E | 1380 | 11.8 | 14.0 | |
| 23 | F | 1319 | 10.4 | 13.4 | |
| 24 | G | 866 | 7.7 | 8.9 | |
| 25 | H | 439 | 12.4 | 6.7 | |
| 26 | I | 1203 | 20.4 | 23.5 | |
| 27 | J | 861 | 8.7 | 7.1 | |
| 28 | K | 1084 | 22.7 | 26.8 | |

TABLE 4-continued

| TEST NO. | ALLOY NO. | CREEP RUPTURE TEST UNDER 300 MPa AT 700° C. CREEP RUPTURE TIME (h) | ELONGATION AFTER CREEP FRACTURE (%) | TENSILE TEST UNDER ULTRA-SLOW STRAIN RATE AT 700° C. REDUCTION IN AREA AFTER FRACTURE (%) | REMARKS |
|---|---|---|---|---|---|
| 29 | L | 697 | 24.0 | 21.7 | |
| 30 | M | 556 | 20.1 | 24.3 | |
| 31 | N | 2014 | 2.7 | 3.8 | |
| 32 | O | 608 | 22.4 | 26.0 | |
| 33 | P | 2213 | 3.7 | 3.1 | |
| 34 | Q | 561 | 5.4 | 6.9 | |
| 35 | R | 2610 | 4.8 | 3.8 | |
| 36 | S | 1435 | 24.6 | 19.7 | |

As shown in Table 4, in the example Nos. 1 to 17 which corresponded to the alloy Nos. 1 to 17 that satisfied the chemical composition of the present invention, all of the suppression effects of the reheat cracking, such as the creep rupture time, the creep rupture ductility, and the reduction of area obtained by the tensile test at the slow strain rate, were acceptable.

On the other hand, in the comparative example Nos. 18 to 36 that did not satisfy the range specified by the present invention, at least one of the creep rupture time, the creep rupture ductility, and the reduction of area obtained by the tensile test at the slow strain rate was insufficient as compared with the example Nos. 1 to 17.

INDUSTRIAL APPLICABILITY

The Ni-based alloy according to the above aspects of the present invention is the alloy in which the creep rupture strength is excellent, the ductility (creep rupture ductility) after usage for a long time in high-temperature is drastically improved, and the reheat cracking or the like which may occur at welding for repair or the like is suppressed. Therefore, it is possible to appropriately apply the Ni-based alloy to plates, bars, forgings, or the like which are used as alloy tubes and heat resisting and pressure resisting materials in boilers for power generating plants, chemical industrial plants, or the like. Accordingly, the present invention has significant industrial applicability.

The invention claimed is:

1. A Ni-based alloy comprising, as a chemical composition, by mass %, 0.001% to 0.15% of C,
0.01% to 2% of Si,
0.01% to 3% of Mn,
15% to less than 28% of Cr,
3% to 15% of Mo,
more than 5% to 25% of Co,
0.2% to 2% of Al,
0.2% to 3% of Ti,
0.0005% to 0.01% of B,
0% to 3.0% of Nb,
0% to 15% of W,
0% to 0.2% of Zr,
0% to 8% of Ta,
0% to 8% of Re,
0% to 15% of Fe,
f1 expressed by a following Expression 1 or less of P,
0.01% or less of S,
at least one selected from
0.005% to 1% of Hf,
0.0005% to 0.05% of Mg,
0.0005% to 0.05% of Ca,
0.0005% to 0.5% of Y,
0.0005% to 0.5% of La,
0.0005% to 0.5% of Ce,
0.0005% to 0.5% of Nd, and
a balance consisting of Ni and impurities,
wherein, an average grain size d is an average grain size in unit of μm of a γ phase included in a metallographic structure of the Ni-based alloy, and the average grain size d is 10 μm to 300 μm,
wherein precipitates with a major axis of 100 nm or more are absent in the metallographic structure, and
wherein, an area fraction ρ is expressed by a following Expression 2 using the average grain size d and amounts in unit of mass % of each element in the chemical composition, and the area fraction ρ is f2 expressed by a following Expression 3 or more, $$f1=0.01-0.012/[1+\exp\{(B-0.0015)/0.001\}] \quad \text{(Expression 1)}$$

$$\rho=21\times d^{0.15}+40\times(500\times B/10.81+50\times C/12.01+Cr/52.00)^{0.3} \quad \text{(Expression 2)}$$

$$f2=32\times d^{0.07}+115\times(Al/26.98+Ti/47.88+Nb/92.91)^{0.5} \quad \text{(Expression 3).}$$

2. The Ni-based alloy according to claim 1 comprising, as the chemical composition, by mass %, 0.05% to 3.0% of Nb.

3. A Ni-based alloy tube comprising a Ni-based alloy according to claim 2 for a production thereof.

4. The Ni-based alloy according to claim 2 comprising, as the chemical composition, by mass %, at least one selected from 0.005% to 0.2% of Zr,
0.01% to 8% of Ta,
0.01% to 8% of Re, and
1.5% to 15% of Fe.

5. A Ni-based alloy tube comprising a Ni-based alloy according to claim 4 for a production thereof.

6. The Ni-based alloy according to claim 2 comprising, as the chemical composition, by mass %, 1% to 15% of W.

7. A Ni-based alloy tube comprising a Ni-based alloy according to claim 6 for a production thereof.

8. The Ni-based alloy according to claim 6 comprising, as the chemical composition, by mass %, at least one selected from 0.005% to 0.2% of Zr,
0.01% to 8% of Ta,
0.01% to 8% of Re, and
1.5% to 15% of Fe.

9. A Ni-based alloy tube comprising a Ni-based alloy according to claim 8 for a production thereof.

10. The Ni-based alloy according to claim 1 comprising, as the chemical composition, by mass %, 1% to 15% of W.

11. The Ni-based alloy according to claim 10 comprising, as the chemical composition, by mass %, at least one selected from 0.005% to 0.2% of Zr, 0.01% to 8% of Ta, 0.01% to 8% of Re, and 1.5% to 15% of Fe.

12. A Ni-based alloy tube comprising a Ni-based alloy according to claim 11 for a production thereof.

13. A Ni-based alloy tube comprising a Ni-based alloy according to claim 10 for a production thereof.

14. The Ni-based alloy according to claim 1 comprising, as the chemical composition, by mass %, at least one selected from 0.005% to 0.2% of Zr, 0.01% to 8% of Ta, 0.01% to 8% of Re, and 1.5% to 15% of Fe.

15. A Ni-based alloy tube comprising a Ni-based alloy according to claim 14 for a production thereof.

16. A Ni-based alloy tube comprising a Ni-based alloy according to claim 1 for a production thereof.

* * * * *